United States Patent [19]

Yuen

[11] Patent Number: 4,842,098

[45] Date of Patent: Jun. 27, 1989

[54] ADJUSTABLE FOLDING LADDER

[76] Inventor: Haison Yuen, 2-1, Jinlon Rd, Jeo-Ay Village, Yen-Pu Shian, Pintung Hsien, Taiwan

[21] Appl. No.: 114,022

[22] Filed: Oct. 29, 1987

[51] Int. Cl.[4] ..... E06C 1/28; E06C 7/08

[52] U.S. Cl. ..... 182/22; 182/46; 182/27; 182/163; 182/228; 16/351; 403/97

[58] Field of Search ..... 182/21, 22, 23, 24, 182/27, 163, 164, 46, 228; 403/97; 16/351

[56] References Cited

U.S. PATENT DOCUMENTS

| | | | |
|---|---|---|---|
| 1,894,489 | 1/1933 | Hirose | 182/27 |
| 3,143,185 | 8/1964 | Wenger | 182/27 |
| 3,554,318 | 1/1971 | Knight | 182/27 |
| 4,566,150 | 1/1986 | Boothe | 182/22 |
| 4,666,327 | 5/1987 | Su | 182/24 |
| 4,666,328 | 5/1987 | Ryu | 182/163 |

*Primary Examiner*—Reinaldo P. Machado
*Attorney, Agent, or Firm*—Larson and Taylor

[57] ABSTRACT

The invention is an adjustable folding ladder that can be easily altered in its length and shape to adjust to the proper working height and angles for the user. With the fiber glass nylon hinges, the ladder is insulated to prevent the user from electrical shocks in the event the ladder comes into contact with electrical wiring.

3 Claims, 6 Drawing Sheets

ADJUSTABLE FOLDING LADDER

BACKGROUND OF THE INVENTION

Standard folding ladders are available in 12', 16' and 20' length increments. It is hazardous to perform work at high levels using a ladder of improper length. On the other hand, it is inconvenient to carry ladders of various lengths to the work site. And for household use, it is not economical to purchase more than one ladder. Normal size households do not have storage available for long ladders.

Whether the user is using the ladder at home or at the job site, there are times that the user may be working close to electrical wiring. If the ladder comes into contact with the wiring and it is not properly grounded, it may produce an electrical shock to the user. An all metal ladder will be hazardous in such situation.

This invention is an adjustable folding ladder designed to solve the aforementioned concerns for the users. The ladder is designed to allow users to adjust the length of the ladder to various heights, up to 20 feet, where they need to perform their work. This feature allows the users the flexbility of not having to carry more than one ladder to the work site. In addition, the ladder also features a fiber glass nylon hinge to provide insulation and proper grounding. It insulates the users from electrical shock in case the ladder comes into contact with electrical wiring.

SUMMARY OF THE INVENTION

This invention is an adjustable folding ladder allowing the user to adjust the ladder to the proper length to reach the level where work needs to be performed. It also features a design to insulate the user from electrical shock.

This adjustable folding ladder is composed of four sections connected with three pairs of hinged joints. Each section is made up of two upright legs, connectors at the hinged joints and horizontal rungs between the uprights for stepping. Two sections are connected with hinged joints on each side with a connector machined with left-handed threads on one end and right-handed threads on the other. Combined with the corresponding threads on the hinged joints screws, the connector can be turned one way to tighten the hinged joints to fix the position of the ladder. Turning the connector the opposite way will loosen up the hinged joint for adjusting the relative position of the sections to various angles and for changing the height of or folding the ladder. The ladder is generally stored in the folded position.

DETAILED DESCRIPTION OF THE INVENTION

Figure 17:
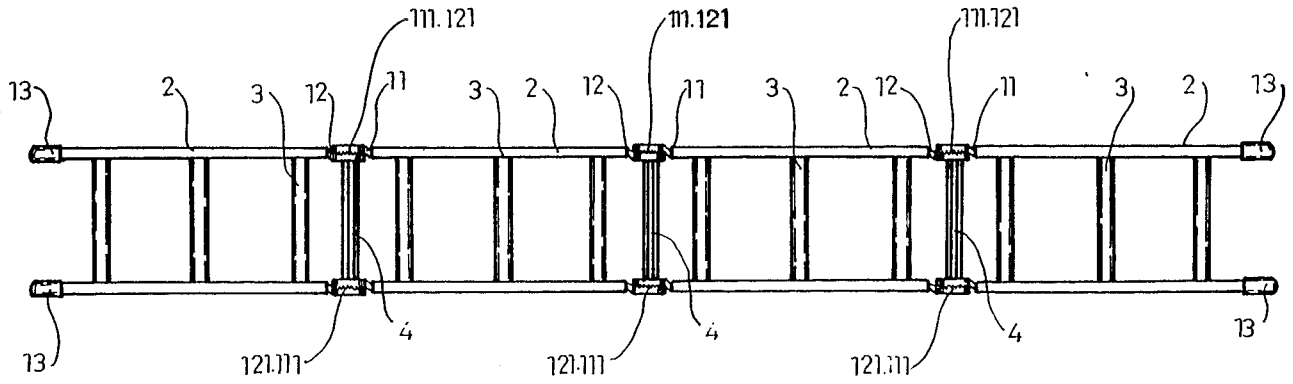
FIG. 17 is a front view of the ladder in this invention in its maximum length position.

The ladder in this invention, as shown in FIG. 17, consists of six hinged joints 1, eight uprights 2, twelve rungs 3 and three connectors 4 as its main parts.

Hinged joint 1 consists of a male hinge 11 and a female hinge 12 made of insulation material, fiber glass nylon.

Figure 1:
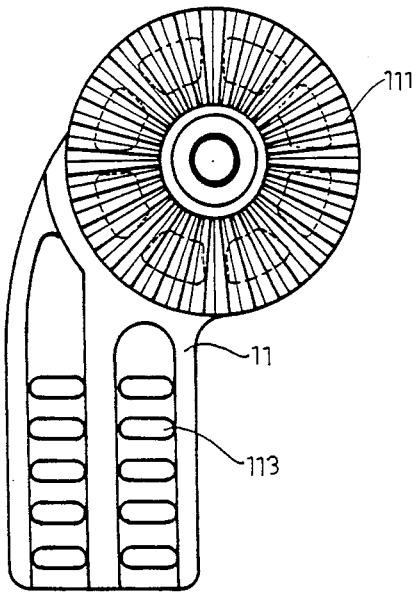
FIG. 1 is a front view of the male hinge in this invention.
Figure 2:
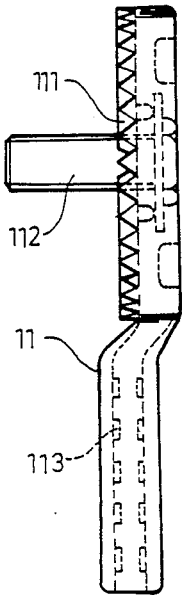
FIG. 2 is a side view of the male hinge in this invention.

The male hinge 11, as shown in FIGS. 1 and 2, has precut teeth 111 and a screw inserted in the center. The threads of the screw for the male hinge on one side of the upright is left-handed. The threads of screw for the male hinge on the other side of the upright is right-handed. The handle of the male hinge has multiple grooves 113 cut inward.

Figure 3:
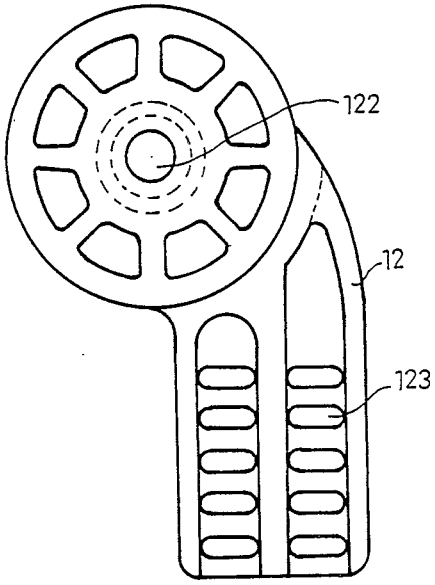
FIG. 3 is a front view of the female hinge in this invention.
Figure 4:
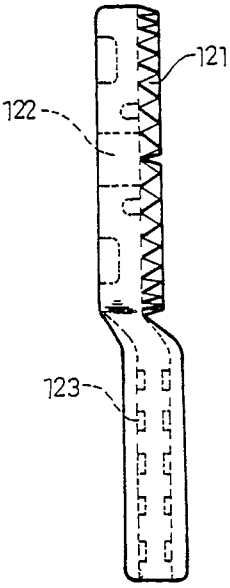
FIG. 4 is a side view of the female hinge in this invention.
Figure 11:
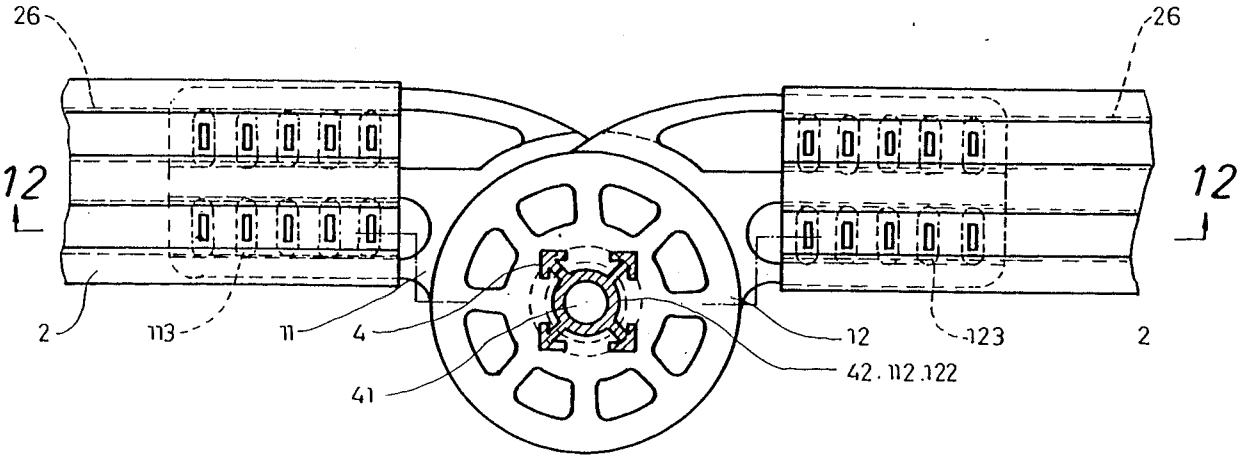
FIG. 11 is an upside view of the hinge joint inserted in the uprights of the ladder in this invention.
Figure 12:
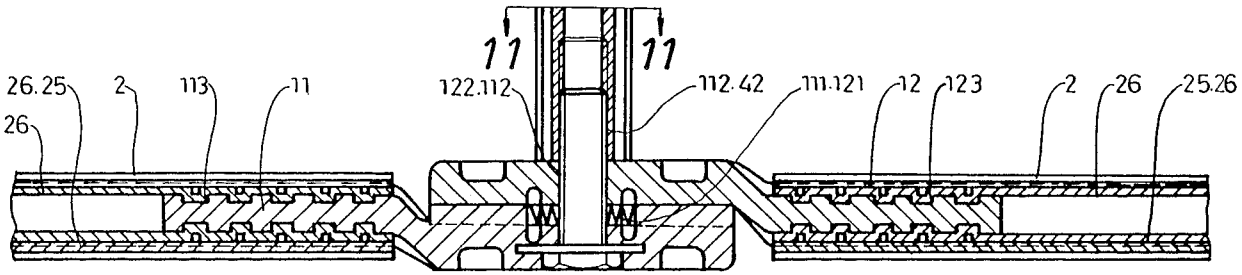
FIG. 12 is a cross-sectional view of the 12—12 line in FIG. 11.

The female hinge 12, as shown in FIGS. 3 and 4, has precut teeth 121 and multiple grooves 123 similar to those in the male hinge. The teeth are cut to mesh with those in the male hinge as shown in FIGS. 11 and 12. The screw 112 of the male hinge is to be inserted in the axle hole 122 in the center of the female hinge 12.

Figure 6:
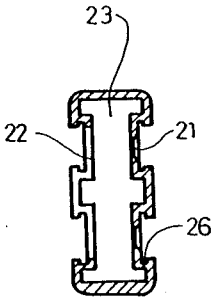
FIG. 6 is a side view of the upright of the ladder in this invention.
Figure 5:
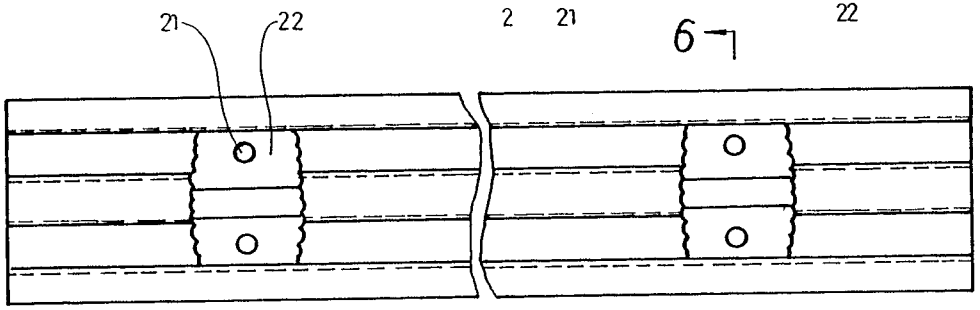
FIG. 5 is an upside view of the upright of the ladder in this invention.

The upright 2 as shown in FIGS. 5 and 6 is made of aluminum. It is shaped by pressing. It is hollow with a lengthwise inner hole. Its ends have 10 grooves punched in to fit the corresponding grooves 113 of the male hinge 11 or the grooves 123 of the female hinge 12. When the handle of the male hinge 11 or the female hinge 12 is inserted in the lengthwise inner hole in the upright, the grooves on the handle will lock in with the corresponding grooves on the upright, thus combining the hinged joint 1 and the upright 2 without drilling and riveting, as shown in FIG. 11.

The upright 2 also has round flat-head screw holes 21 and grooves 22 produced by pressing. The ends of the rung fit in the grooves 22 and are secured to the uprights by flat-head screws 24 through holes 21. This way of securing the rungs provides increased stepping weight capacity. Long metal strips 25 are then inserted in the stabilizing grooves 26 with tight tolerance lengthwise in the upright 2 to prevent the flat-head screws 24 from loosening. Besides, it made the screws invisible from outside.

Figure 8:
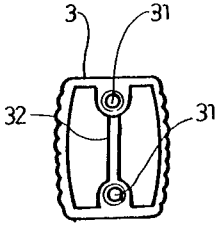
FIG. 8 is a side view of the rung of the ladder in this invention.
Figure 7:
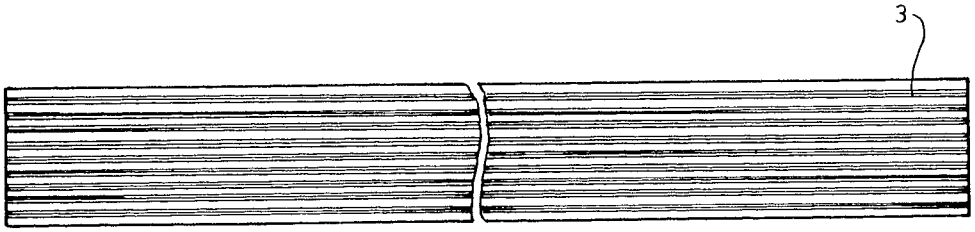
FIG. 7 is a top view of the rung of the ladder in this invention.

The rung 3, as shown in FIGS. 7 and 8, is made of aluminum. It has lengthwise swellings to produce a rough surface for increased traction. This feature minimizes slippage for safety when the user climbs up the ladder. The cross-section is tubular shape to increase the strength of the rung. The holes 31 and wall 32 fit in with the holes 21 and grooves 22 on the upright 2 for fastening purposes to provide additional strength.

Figure 10:
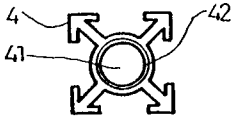
FIG. 10 is a side view of the connector of the ladder in this invention.
Figure 9:
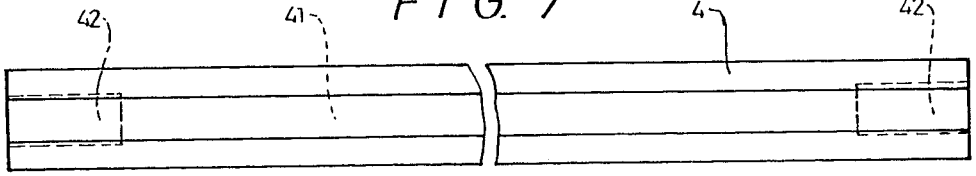
FIG. 9 is a top view of the connector of the ladder in this invention.

The connector 4, as shown in FIGS. 9 and 10, is made of aluminum. It has a lengthwise round hole 41 with one end cut with female left-handed threads and the other end with female right-handed threads. The corresponding left-hand or right-hand threaded screw 112 on the male hinge 11 is used to attach the connector to the hinged joint 1.

FIGS. 11 and 12 show the hinged joint 1 is attached to the uprights 2. By pinching the outside of the upright 2 with the appropriate tool, the grooves 113 on the male hinge 11 or the grooves 123 on the female hinge 12 can be fitted into the 10 grooves punched in at the end of the upright 2. This fitting process results in a permanent locking position between the hinged joint 1 and the upright 2 to minimize any future separation between the two. Connector 4 is then attached to the hinged joints 1 on both sides by tightening flat-head screw 112. As mentioned previously, the flat-head screw 112 has two types of male threads, left-handed and right-handed. Each type is used in fastening the connector 4 on opposite sides to the hinged joint 1. One way turning of the connector 4 can loosen up both screws 112 on both ends of the connector. When the flat-head screws 112 are loosened, teeth 111 of the male hinge 11 disengage from teeth 121 of the female hinge 12. This action allows the user to rotate the hinged joint to adjust the angle between two sections of the ladder. When the proper angle or position is attained, the connector 4 can be turned the opposite direction to tighten the flat-head screws 112. When the screws are tightened, the teeth on the male and female hinges are locked in the proper position desired by the user.

Figure 14:
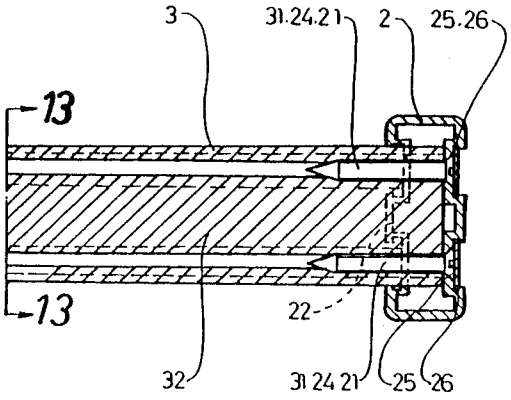
FIG. 14 is a cross-sectional view of the 14—14 line in FIG. 13.
Figure 13:
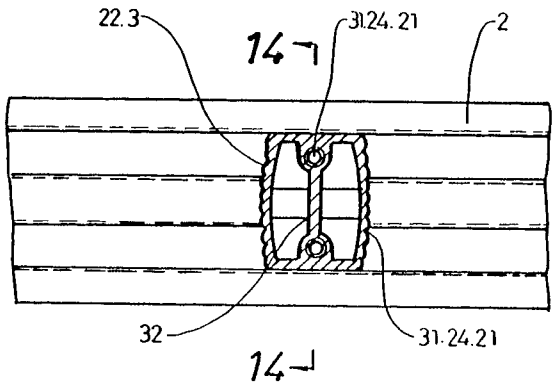
FIG. 13 is an upside view of the upright with a cross-sectional view of a rung attached to the upright.

As shown in FIGS. 13 and 14, rung 3 is attached to the upright 2 by flat-head screw 24 through the holes on the upright 21 and the rung 31. After all the rungs are attached, a long metal strip 25 is then inserted lengthwise in the grooves 26 on the upright to prevent the screws from loosening, and screws are invisible from outside.

Figure 15:
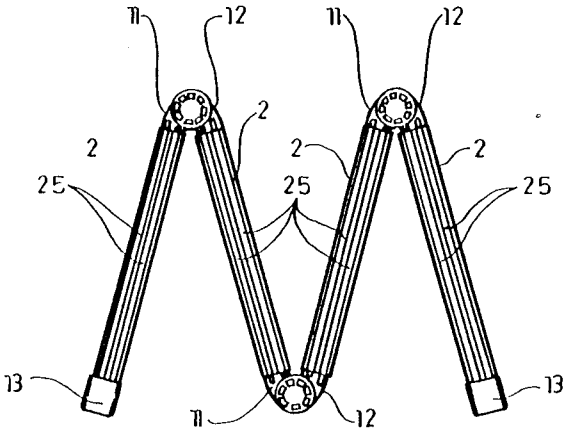
FIG. 15 is a side view of the ladder in this invention folded to its minimum size for storage.
Figure 16:
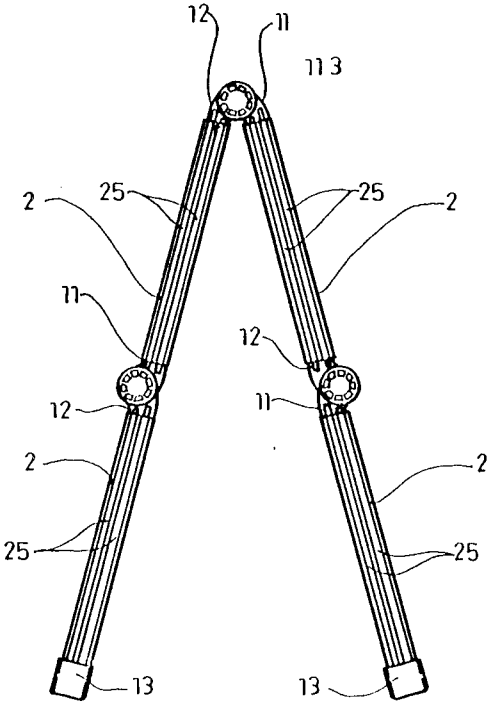
FIG. 16 is a side view of the ladder in this invention in a reversed V-shape position.

The adjustable folding ladder in this invention is composed of four straight sections connected by three pairs of hinged joints. When folded in its fully retracted position, it measures one quarter of its fully extended length. It can be adjusted into an M-shape (FIG. 15), a reversed V-shape (FIG. 16) or a straight length when fully extended. The alteration of its shape can be accomplished by turning the connectors 4 to loosen the hinged joints 1 on both sides simultaneously; separating teeth 111 of the male hinge from those of the female hinge; adjusting the hinged joint to attain the desired angle and then turning the connectors 4 to tighten the hinge joints to lock them in position.

This ladder has several advantages. It allows the user flexibility when adjusting to various positions. It provides insulation from electrical shocks. Plastic stoppers are affixed at the ends of the uprights for the first and last sections of the ladder to prevent the ladder from slipping.

What is claimed is:

1. An adjustable folding ladder, said ladder comprising:

A pair of uprights;

A plurality of rungs supported by said uprights; and hinged joints made of fiber glass nylon providing electrical shock insulation, each composed of a male and a female hinge with matching teeth for close tollerance engagement, having handles with grooves, and having screws with either left-handed or right-handed threads to fit through the male hinge in the middle of its teeth and through a hole in the middle of the female hinge, said uprights being made of aluminum and including a lengthwise hollow hole to fit the handle of the hinged joint, a plurality of grooves to fit the corresponding grooves on the hinged joint to provide a permanent locking position, a plurality of round flat-head screw holes and grooves to fit the rungs, and longitudinal slots to allow a long metal strip to be inserted lengthwise to prevent flat-head screws received in said flat-head screw holes from loosening, said rungs being made of aluminum in tube shape to provide rigidity, having lengthwise swellings to minimize slipping, and having screw holes and walls to be attached to the uprights by respectively screwing and fitting into the corresponding said holes and grooves in the uprights to provide increased load carrying capacity, and said ladder further comprising connectors having female left-hand and right-hand threaded holes on opposite ends to fit the corresponding screws of the hinged joints such that the hinged joints can be tightened or loosened by turning the connector.

2. The adjustable folding ladder as claimed in claim 1, wherein two uprights are connected together with a hinged joint to make up a leg of this ladder, and two legs are symmetrically connected by said rungs and said connectors.

3. The adjustable folding ladder as claimed in claim 1, wherein when the hinged joints are loosened by turning the connector, the teeth of both the male and female hinges can be separated to allow the user to adjust the angle between the legs of the ladder, and by adjusting the angles between the legs, the ladder can be shaped into different configurations.

* * * * *